United States Patent [19]

Kugimoto

[11] Patent Number: 4,958,550

[45] Date of Patent: Sep. 25, 1990

[54] TUNING METHOD AND APPARATUS FOR KEYBOARD MUSICAL INSTRUMENT

[75] Inventor: Hidenori Kugimoto, Hamamatsu, Japan

[73] Assignee: Kabushiki Kaisha Kawai Gakki Seisakusho, Hamamatsu, Japan

[21] Appl. No.: 244,049

[22] Filed: Sep. 13, 1988

[30] Foreign Application Priority Data

Sep. 14, 1987 [JP] Japan ..... 67-228484

[51] Int. Cl.[5] ..... G10G 7/02

[52] U.S. Cl. ..... 84/454; 84/455; 84/DIG. 18

[58] Field of Search ..... 84/454, 455, DIG. 18

[56] References Cited

U.S. PATENT DOCUMENTS

| | | | |
|---|---|---|---|
| 3,405,590 | 10/1968 | Pease . | |
| 3,412,638 | 11/1968 | Pease . | |
| 4,044,239 | 8/1977 | Shimauchi et al. | 84/455 X |
| 4,375,180 | 3/1983 | Scholz | 84/454 |
| 4,426,907 | 1/1984 | Scholz | 84/454 |
| 4,791,849 | 12/1988 | Kelley | 84/454 X |
| 4,803,908 | 2/1989 | Skinn et al. | 84/454 |

FOREIGN PATENT DOCUMENTS

| | | | |
|---|---|---|---|
| 1296960 | 6/1969 | Fed. Rep. of Germany . | |
| 3200288 | 9/1983 | Fed. Rep. of Germany . | |
| 46-34469 | 10/1971 | Japan . | |
| 5431888 | 9/1976 | Japan . | |
| 53-54011 | 5/1978 | Japan . | |
| 54-31889 | 10/1979 | Japan . | |
| 2116768 | 9/1983 | United Kingdom | 84/455 |

*Primary Examiner*—Steven L. Stephan
*Assistant Examiner*—Emanuel Todd Voeltz
*Attorney, Agent, or Firm*—Michael N. Meller

[57] ABSTRACT

A tuning apparatus for a keyboard musical instrument, having a load applicator for applying a load of a predetermined value to a string set up in place, a calculating device for calculating a deviation between a displacement value of the string produced when the load is applied to the string and a preset value of displacement predetermined to give a required frequency of vibration, and a rotating device for turning a tuning pin until the deviation calculated by the calculating device is reduced to zero.

4 Claims, 3 Drawing Sheets

TUNING METHOD AND APPARATUS FOR KEYBOARD MUSICAL INSTRUMENT

FIELD OF THE INVENTION

This invention relates to a method and an apparatus designed primarily for carrying out a preliminary tuning of a keyboard musical instrument, that is, a rough tuning thereof performed prior to a fine, regular tuning thereof.

BACKGROUND OF THE INVENTION

A conventional method for a regular and a preliminary tuning of a keyboard musical instrument comprises the following steps of:

(1) vibrate a string;

(2) judge a tonal pitch from sonic vibrations thereof; and (3) based on the judgment made in step (2), turn a tuning pin to carry out the tuning operation.

Usually, tuning of a string by this method is so performed that the above-listed tuning steps (1)—(3) are repeated several times to complete the tuning.

According to the aforementioned conventional method, in the case of a piano equipped with 230 strings, for example, it is necessary to individually tune each string, as a result of which much time and labor is required to tune a piano. Furthermore, when tuning step (1) is to be performed for a key which actuates a plurality of strings in unison, it is necessary to apply pieces of rubber, felt or the like to other strings so as to prevent those strings from generating sound by vibration when the key is stricken for tuning of a string other than those strings. This makes the tuning operation very complex. In addition, since a string-exciting mechanism is required in order to carry out tuning step (1), the tuning should be performed in such a condition that an action mechanism has been incorporated therein. This limits the freedom of selecting the sequence of tuning steps. In tuning step (2), it is a general practice that, for comparison, the reference string is vibrated simultaneously with the string to be tuned and a tune pitch thereof is judged from the frequency of a beat tone so generated, so that a comparatively high expertness in the art is required to perform this step. Accordingly, in actuality all tuning operations are almost exclusively performed by professional tuning experts.

SUMMARY OF THE INVENTION

The object of the present invention is to solve the foregoing problems inherent in the conventional method.

In order to achieve this object, the first aspect of the present invention is characterized by such an arrangement that, while a load of a preset value or a load so applied as to produce a predetermined value of displacement is being applied to a string, a tuning pin is turned until a value of displacement of the string so produced or a reaction force generated by a tension of the string so produced corresponds to a preset displacement value or a preset load value, which is predetermined to give a required frequency of vibration. The second aspect of the present invention is characterized in that it comprises a load-applying means which applies a load of a predetermined value to a string set up in place or which is so adapted to apply a load to a string set up in place as to produce a predetermined value of displacement of the string, a calculation means which calculates a deviation between displacement value of the string shown when the load-applying means is applied to the string and a preset value of displacement predetermined to give a required frequency of vibration or a deviation between a reaction force generated by a tension of the string produced when the load-applying means is applied to the string and a preset value of load predetermined to give a required frequency of vibration, and a rotating means which turns a tuning pin until the deviation calculated by the calculation means is reduced to zero.

DETAILED DESCRIPTION OF THE PREFERRED EMBODIMENT

In general, the frequency f of vibration of a stretched string is calculated by the equation:

$$f = \frac{1}{2L}\sqrt{\frac{T}{\tau}} \tag{1}$$

where L is the length of the string, T is the tension of the string, and $\tau$ is the linear density of the string (weight per unit length).

Figure 1:
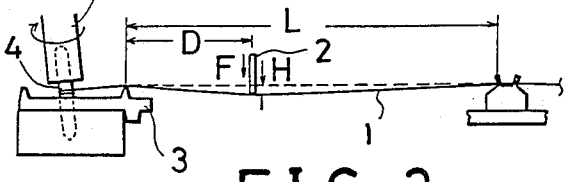
FIG. 1 is a schematic diagram illustrating the operation of the present invention.

Further, as shown in FIG. 1, there is a correlation between a load F applied to the location D at which string 1 is struck and a displacement H of the string 1 when load F is applied at location D, this correlation being expressed by the equation:

$$H = \frac{F \cdot D(L - D)}{T \cdot L} + G \tag{2}$$

where G is a correction factor due to rigidity or the like of the string.

Therefore, a tension $T_s$ at a preset frequency $f_s$ of the string 1 having a length L and a linear density can be calculated by equation (1), while a displacement H of the string 1 having a tension $T_s$ and a load F applied thereto can be calculated by equation (2).

According to this invention, while applying by a load member 2a predetermined load F to the location D at which the string 1 is struck, a tuning pin 4 attached by screws to a frame 3 is turned by means of a tuning pin rotation member 5 until a displacement H of string 1 at position D corresponds to a predetermined displacement value $H_s$ calculated by equation (2) for a preset frequency $f_s$, whereby tuning of string 1 is performed.

Instead of applying a predetermined load $F_s$ at location D of string 1, such a load f as to produce a predetermined displacement $H_s$ may be applied thereto and, while so doing, the tuning pin 4 is turned by means of the tuning pin rotation member 5 until a reaction force generated by a tension of the string 1 at location D corresponds to a predetermined load $F_s$ calculated by equation (2) for a preset frequency $f_s$, thereby setting the frequency f of the string to the preset frequency $f_s$.

The predetermined displacement and load values should be in the range where they are least affected by the rigidity characteristic of the string 1, and should be determined by taking into consideration the measuring accuracy of a displacement measuring sensor and the length of the string. Tuning accuracy depends on whether these predetermined values are appropriate or not.

According to the second aspect of the present invention, the above-described string tuning operations are all carried out automatically.

A preferred embodiment of the present invention will now be described with reference to FIG. 2 which is a block diagram showing an apparatus wherein a predetermined load is applied to a string.

Figure 2:
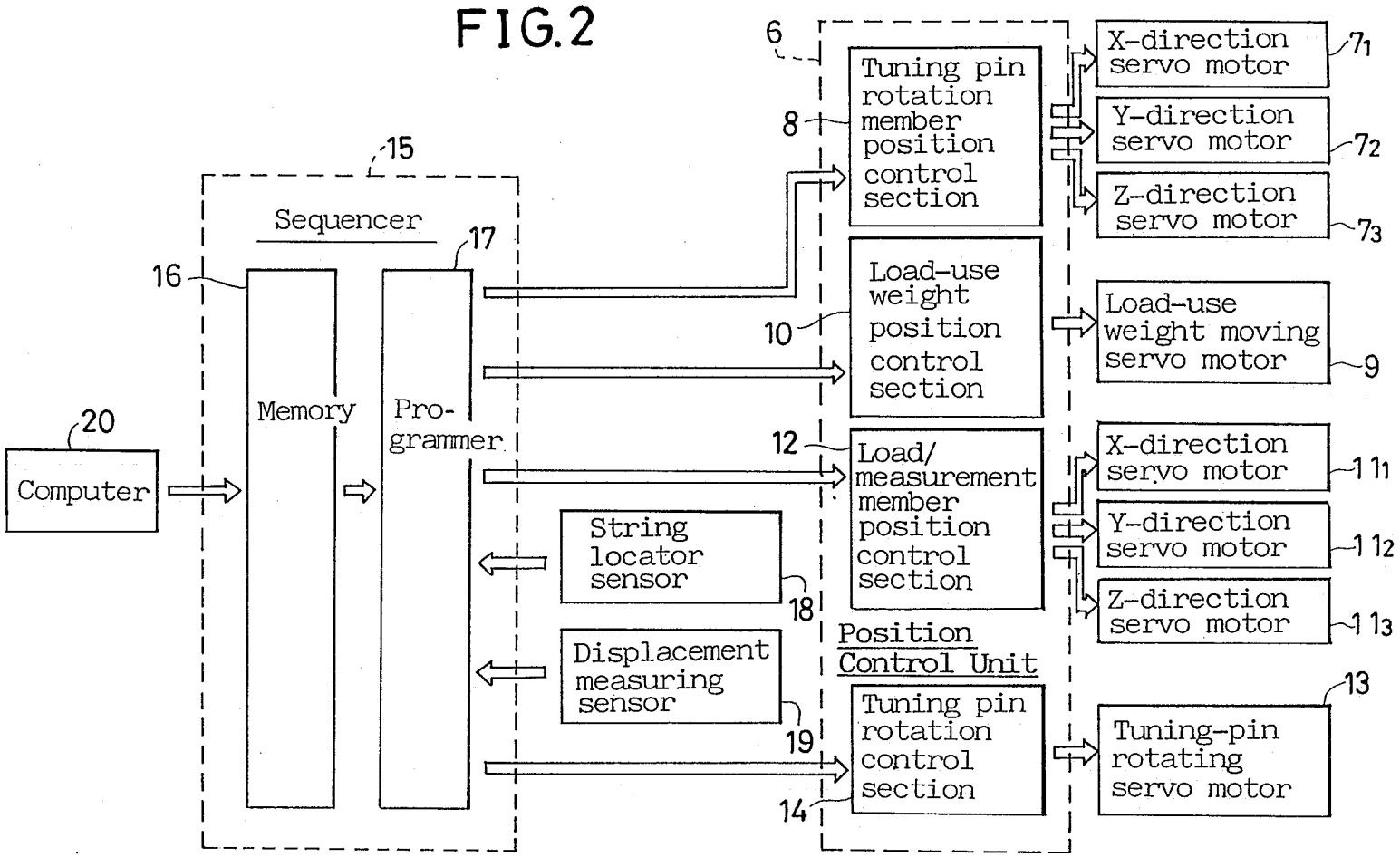
FIG. 2 is a block diagram illustrating a preferred embodiment of the present invention for carrying out one of the tuning methods disclosed herein.

Referring to FIG. 2, numeral 6 denotes a position control unit comprising: (a) a tuning pin rotation member position control section 8 serving to control an X-direction servo motor $7_1$, a Y-direction servo motor $7_2$ and Z-direction servo motor $7_3$ which are used to move the tuning pin rotation member 5 up to the location of the tuning pin 4 so that the rotation member 5 engages the tuning pin 4 screwed into the frame 3 placed in a predetermined location as shown in FIG. 1; (b) a load-use weight moving servo motor 9 which is used to move the weight so as to set up a load suitable for the length and tension of the string; (c) a load/measurement member position control section 12 serving to control an X-direction servo motor $11_1$, a Y-direction servo motor $11_2$ and a Z-direction servo motor $11_3$ which are used to move a load/measurement member, the load/measurement member being (represented by numeral 21 in FIG. 3.) up to a location of the load member 2 used to apply a load to the string 1 and measure a displacement of the string 1 from its stretched condition; and (D) a tuning pin rotation control section 14 serving to control a servo motor 13 which is used to rotate the tuning pin. All of the control sections include a known servo circuit. Numeral 15 denotes a sequencer which comprises a memory 16 and a programmer 17.

Stored in the memory 16 are X, Y and Z coordinates of a predetermined load value, X, Y and Z coordinates of a load point location and a predetermined displacement value. The programmer 17 feeds position control signals read out from the memory 16, to the tuning pin rotation member position control section 12 so as to operate them, which signals correspond respectively to the tuning pin location, the predetermined load value and the load point location. After the load/measurement member 21 has stopped at a position a predetermined distance away from the predetermined load point location, string locator sensor 18 is operated to find the location of the string 1. This location is then fed back for controlling the load/measurement member 21 so that it is positioned at the center of the string 1. Thereafter, control signals read out from the memory 16 which correspond to the predetermined load value are inputted to the load-use weight position control section 10. At the time when the predetermined load is applied to the string 1, a deviation between the predetermined displacement value read out from the memory 16 and a displacement value measured by a displacement measuring sensor 19 is calculated so that the programmer 17 may continue to input operation signals to the tuning pin rotation control section 14 until said deviation is reduced to zero.

In memory 16 only data for a predetermined type of piano are stored. When a different type of piano is to be tuned, new data therefor are inputted into memory 16 from a computer 20.

Likewise, when the predetermined displacement value or the like is to be modified, the modified data should be newly inputted from the computer.

Figure 3:
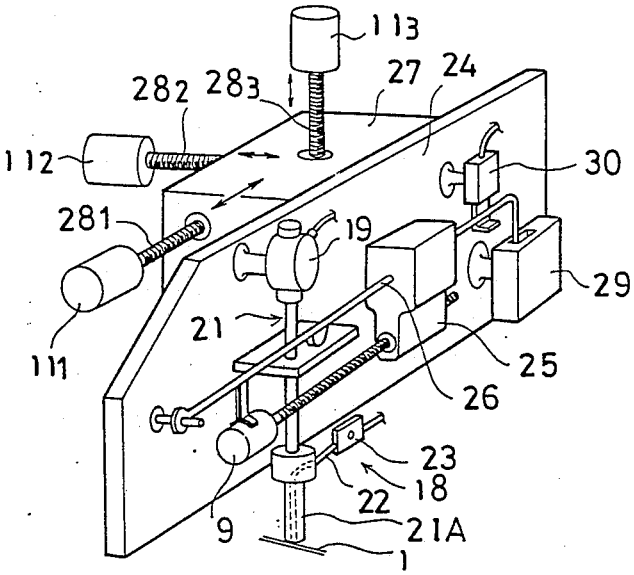
FIG. 3 is a perspective view showing a load/measurement member and a moving mechanism in accordance with the preferred embodiment of the invention.

The above-described load/measurement member 21 is, for example, as shown in FIG. 3, so constructed that it can freely move and adjust the load.

In FIG. 3, numeral 21A denotes a tubular-shaped tip of the load/measurement member. Tip 21A has optical fibers 22 inserted therein. An optical sensor 23 that casts and receives light simultaneously is connected to these fibers to form the string locator sensor 18. A displacement measuring sensor 19, consisting of a dial gauge which outputs electrical signals representing a displacement of the tip, is provided above the tubular-shaped tip 21A. Further, attached to the load/measurement member 21 is a balance 26 whose one end is pivotally supported on a board member 24, on which is mounted the sensor 19, and whose other end has a load-use weight 25 movably attached thereto. The load-use weight 25 is slidable by the servo motor 9 so that a desired load may be applied to the string 1 through the tubular-shaped tip 21A. Tip 21A is freely adjustable in its position by turning screw bolts $28_1$, $28_2$ and $28_3$ respectively by means of X-, Y- and Z-direction servo motors $11_1$, $11_2$ and $11_3$ (which are all mounted on a fixture member not shown), these screw bolts being partially screwed into and thus held on a block 27 fixedly attached to the board member 24.

In FIG. 3, reference numeral 29 denotes a damper for stopping oscillations between the reaction force of the spring 1 and the load, and reference numeral 30 represents a weight holder member which is used when moving the load/measurement member 21.

Figure 4:
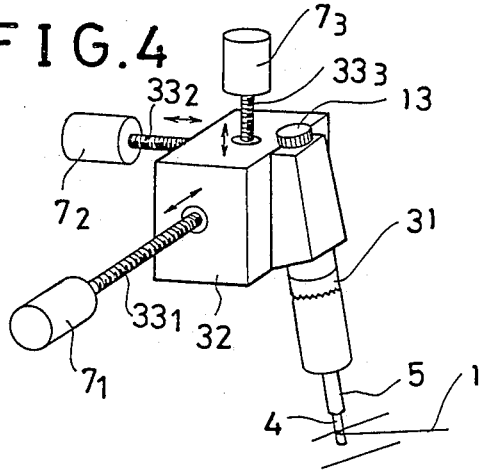
FIG. 4 is a perspective view of a tuning pin rotation member in accordance with the preferred embodiment of the invention.

As shown in FIG. 4, the above-described tuning pin rotation member 5 is so arranged as to be rotated through a clutch 31 by a servo motor 13 for turning the tuning pin 4. The position of tuning pin rotation member 5 can be freely adjusted by rotating screw bolts $33_1$, $33_2$ and $33_3$ respectively by means of X-, Y- and Z-direction servo motors $7_1$, $7_2$ and $7_3$ (all of which are mounted on a fixture member not shown), these screw bolts being partially screwed into and held on a block 32 which supports the servo motor 13.

The above-described tuning apparatus in accordance with the preferred embodiment of the invention can be used to carry out a string tuning method in accordance with the invention. The tuning pin rotation member 5 is moved by servo motors $7_1$, $7_2$ and $7_3$ to be set onto the tuning pin 4 at a location corresponding to the position identification signals outputted by the programmer 17. The load/measurement member 21 is moved by means of servo motors $11_1$, $11_2$ and $11_3$ so as to start the string-locating operation from a location at a predetermined distance (within the range not to result in an erroneous location of a neighboring string) short of the position at which the string is struck and, having located the string, stop at the center of the string.

Moved by the servo motor 9, the load-use weight 25 is also set at the same time to a position at which the predetermined load is produced. Next, the load is applied to the string 1 through the tubular-shaped tip 21A of the load/measurement member 21. In this case, the tubular tip 21A constitutes the load point. The displacement measuring sensor 19 detects a flexure amount of the string 1 and inputs it to the programmer 17 of the sequencer 15. Since the programmer 17 continues to output operation instruction signals until such time when a deviation between the predetermined displacement value read from the memory 16 and a flexure or deflection amount, that is, a displacement of the string 1 measured by the sensor 19, is reduced to zero, the servo motor 13 continues to rotate the tuning pin 4. The tuning pin 4 is always rotated first in such a rotational direction and to such an extent that a tension of the string 1 becomes higher than the preset value and then in the return direction until said deviation is reduced to zero. As the tuning pin completes the above operation, the tuning pin rotation member 5 is disengaged from the tuning pin 4, and the load/measurement member 21 is also disengaged from the string 1.

Figure 5:
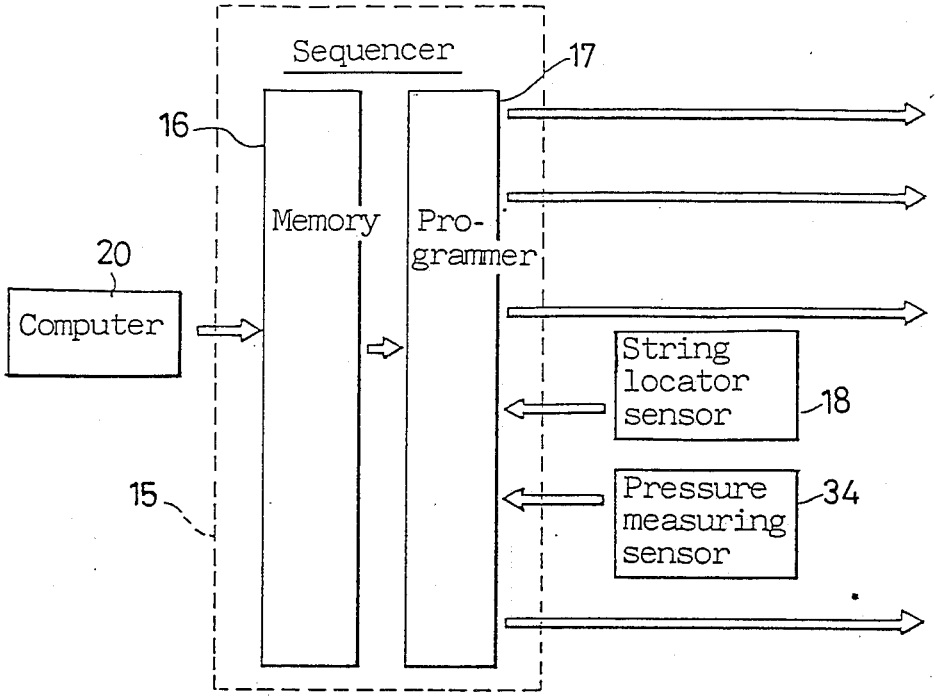
FIG. 5 is a block diagram illustrating the important portions of another preferred embodiment of the present invention.
Figure 6:
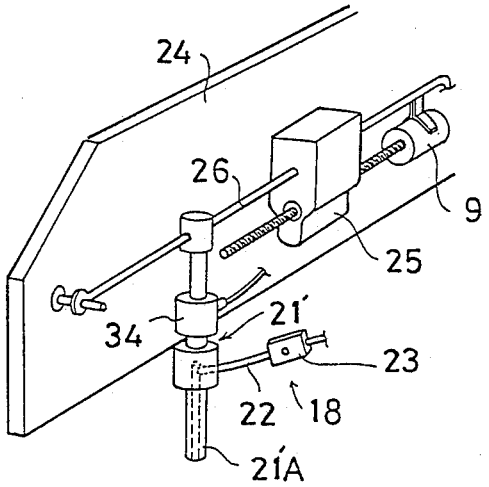
FIG. 6 is a perspective view of a load/measurement member in accordance with the embodiment depicted in FIG. 5.

FIG. 5 is a block diagram illustrating important portions (excluding the position control unit and the servo motors) of a second preferred embodiment of the invention in which the load is applied to the string 1 so that a predetermined displacement thereof is produced, the load/measurement member 21' being constructed as shown in FIG. 6. According to this second embodiment, a load-cell pressure measuring sensor 34 is employed in place of the displacement measuring sensor 19; the programmer 17 supplies position signals corresponding to the tuning pin location and the load position, respectively to the tuning pin rotation member position control section 8 and the load/measurement member position control section 12. These position signals are read out from memory 16, so as to respectively operate control sections. Since it is necessary for the tubular-shaped tip 21A of the load/measurement member to be positioned at the center of the string 1 after the load/measurement member 21' has stopped at the predetermined load position, the string locator sensor 18 is operated to locate the string correctly and feed back the correct location thereof so as to control the load/measurement member 21'. Next, the position identification signals corresponding to the predetermined displacement value of the string 1, which value is read from the memory 16, and signals for the pressure (load)-string location measured by the pressure measuring sensor 34 are supplied to the load/measurement member position control section 12 so as to adjust a displacement of the string 1 to the predetermined displacement value. A deviation between a value of the pressure to be inputted of the string 1 measured by the pressure measuring sensor 34 and the preset pressure value read from the memory 16 is calculated so that operation signals may be supplied to the tuning pin rotation control section 14 until said deviation is reduced to zero.

In accordance with the string tuning method using an apparatus in accordance with the second preferred embodiment, the sequencer 15 is operated to set the tuning pin rotation member 5 to the selected tuning pin 4. The load/measurement member 21 is first moved to a location slightly off the load measuring point and thereafter moved in the horizontal direction to a center of the string 1 located by the string locator sensor 18, where it remains. Next, while the string 1 is kept pressed for the predetermined displacement thereof, the servo motor 13 for rotation of the tuning pin is operated to turn the tuning pin 4 until the pressure of the string 1 detected by the pressure measuring sensor 34 corresponds to the predetermined load value stored in the memory 16.

The other operations are the same as in the method described in connection with the first preferred embodiment.

As described in the foregoing, according to the present invention, when each string of a keyboard musical instrument in which a plurality of strings are struck in unison in response to actuation of a key, it is not necessary to apply rubber pieces or other means to strings not being tuned in order to prevent those strings from vibrating to generate sound, as is required in accordance with the conventional tuning method. Thus it is very easy to carry out the tuning operation. Moreover, according to the present invention, tuning of each string can be carried out when the product is in a semi-complete condition such as before being combined with an action mechanism therefor, so that more operational freedom for the tuning operation is assured for a higher work efficiency.

What is claimed is:

1. A tuning apparatus for a keyboard musical instrument comprising:

load-applying means arranged such that a load-use weight which is movable by a first servomotor is attached to one end of a balance, said balance being pivotally supported at the other end thereof on a first support member which is movable by a second servomotor, and that a load is applied to a string set up in place from the front end of a load-applying member which engages said balance;

measuring means for measuring the displacement of the string at said load-applying member when said load-applying means is in operation; said measuring means being attached to said first support member;

calculation means for calculating a deviation between a displacement value of the string measured by said measuring means and a displacement value of the string preselected to produce a predetermined frequency of vibration; and a rotating member for rotating a tuning pin by a third servomotor until the deviation calculated by said calculation means is reduced to zero, said rotating member being attached to a second support member which is movable by a fourth servomotor.

2. A tuning apparatus for a keyboard musical instrument comprising:

load-applying means arranged such that a load-use weight which is movable by a first servomotor is attached to one end of a balance, said balance being pivotally supported at the other end thereof on a first support member which is movable by a second servomotor, and that a load is applied to a string set up in place from the front end of a load-applying member which engages said balance so as to produce a predetermined displacement value in said string;

measuring means for measuring a reaction force produced by the tension of said string which is applied to said load-applying member when said load-applying means is in operation, said measuring means being connected to said load-applying member;

calculation means for calculating a deviation between the value of said reaction force measured by said measuring means and a value of load preselected to produce a predetermined frequency of vibration; and a rotating member for rotating a tuning pin by a third servomotor until the deviation calculated by said calculation means is reduced to zero, said rotating member being attached to a second support member which is movable by a fourth servomotor.

3. A tuning apparatus for a keyboard musical instrument according to claim 1, wherein a sensor for detecting the location of the string is provided, said sensor comprising an optical fiber inserted into an internal portion of said load-applying member and an optical sensor proper connected to said optical fiber for simultaneously performing downward transmission of and receiving of a light from a front end of said optical fiber so that said load-applying member is stopped at the center of the string in response to an output of said sensor.

4. A tuning apparatus for a keyboard musical instrument according to claim 2, wherein a sensor for detecting the location of the string is provided, said sensor comprising an optical fiber inserted into an internal portion of said load-applying member and an optical sensor proper connected to said optical fiber for simultaneously performing downward transmission of and receiving of a light from a front end of said optical fiber so that said load-applying member is stopped at the center of the string in response to an output of said sensor.

* * * * *

UNITED STATES PATENT AND TRADEMARK OFFICE

CERTIFICATE OF CORRECTION

PATENT NO. : 4,958,550

DATED : September 25, 1990

INVENTOR(S) : Kugimoto

It is certified that error appears in the above-identified patent and that said Letters Patent is hereby corrected as shown below:

The title page, should be deleted to be replaced with the attached title page.

Insert the following claims:

5. The tuning apparatus for a keyboard musical instrument according to claim 1, wherein said first support member is also movable by fifth and sixth servomotors, and said second support member is also movable by seventh and eighth servomotors.

UNITED STATES PATENT AND TRADEMARK OFFICE

CERTIFICATE OF CORRECTION

PATENT NO. : 4,958,550 Page 2 of 3

DATED : September 25, 1990

INVENTOR(S) : Kugimoto

It is certified that error appears in the above-identified patent and that said Letters Patent is hereby corrected as shown below:

6. The tuning apparatus for a keyboard musical instrument according to claim 2, wherein said first support member is also movable by fifth and sixth servomotors, and said second support member is also movable by seventh and eighth servomotors.

Signed and Sealed this

Fifth Day of October, 1993

*Attest:*

Bruce Lehman

BRUCE LEHMAN

*Attesting Officer*

*Commissioner of Patents and Trademarks*

United States Patent [19]

Kugimoto

[11] Patent Number: 4,958,550

[45] Date of Patent: Sep. 25, 1990

[54] TUNING METHOD AND APPARATUS FOR KEYBOARD MUSICAL INSTRUMENT

[75] Inventor: Hidenori Kugimoto, Hamamatsu, Japan

[73] Assignee: Kabushiki Kaisha Kawai Gakki Seisakusho, Hamamatsu, Japan

[21] Appl. No.: 244,049

[22] Filed: Sep. 13, 1988

[30] Foreign Application Priority Data

Sep. 14, 1987 [JP] Japan ..... 67-228484

[51] Int. Cl.[5] ..... G10G 7/02

[52] U.S. Cl. ..... 84/454; 84/455; 84/DIG. 18

[58] Field of Search ..... 84/454, 455, DIG. 18

[56] References Cited

U.S. PATENT DOCUMENTS

| | | | |
|---|---|---|---|
| 3,405,590 | 10/1968 | Pease . | |
| 3,412,638 | 11/1968 | Pease . | |
| 4,044,239 | 8/1977 | Shimauchi et al. | 84/455 X |
| 4,375,180 | 3/1983 | Scholz | 84/454 |
| 4,426,907 | 1/1984 | Scholz | 84/454 |
| 4,791,849 | 12/1988 | Kelley | 84/454 X |
| 4,803,908 | 2/1989 | Skinn et al. | 84/454 |

FOREIGN PATENT DOCUMENTS

| | | | |
|---|---|---|---|
| 1296960 | 6/1969 | Fed. Rep. of Germany . | |
| 3200288 | 9/1983 | Fed. Rep. of Germany . | |
| 46-34469 | 10/1971 | Japan . | |
| 5431888 | 9/1976 | Japan . | |
| 53-54011 | 5/1978 | Japan . | |
| 54-31889 | 10/1979 | Japan . | |
| 2116768 | 9/1983 | United Kingdom | 84/455 |

*Primary Examiner*—Steven L. Stephan
*Assistant Examiner*—Emanuel Todd Voeltz
*Attorney, Agent, or Firm*—Michael N. Meller

[57] ABSTRACT

A tuning apparatus for a keyboard musical instrument, having a load applicator for applying a load of a predetermined value to a string set up in place, a calculating device for calculating a deviation between a displacement value of the string produced when the load is applied to the string and a preset value of displacement predetermined to give a required frequency of vibration, and a rotating device for turning a tuning pin until the deviation calculated by the calculating device is reduced to zero.

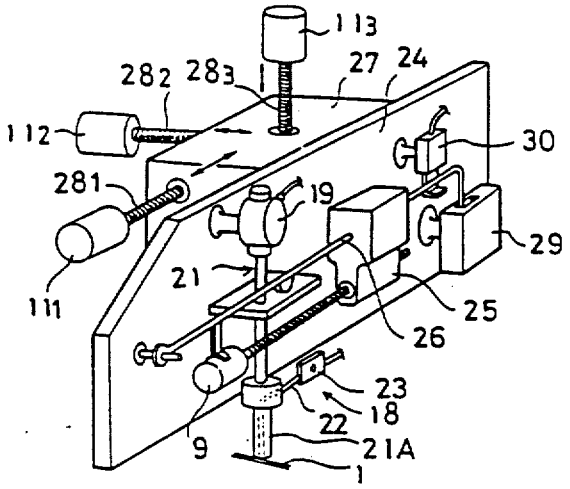

6 Claims, 3 Drawing Sheets